US007367271B2

(12) United States Patent
Early

(10) Patent No.: US 7,367,271 B2
(45) Date of Patent: May 6, 2008

(54) RAILWAY HOPPER CAR DISCHARGE GATE

(75) Inventor: Stephen R. Early, Olathe, KS (US)

(73) Assignee: Aero Transportation Products, Inc., Independence, MO (US)

( * ) Notice: Subject to any disclaimer, the term of this patent is extended or adjusted under 35 U.S.C. 154(b) by 0 days.

(21) Appl. No.: 10/769,261

(22) Filed: Jan. 30, 2004

(65) Prior Publication Data

US 2005/0166788 A1 Aug. 4, 2005

(51) Int. Cl.
*B61D 9/00* (2006.01)

(52) U.S. Cl. ..... 105/282.2

(58) Field of Classification Search ..... 105/239, 105/247, 280, 282.1, 282.2, 282.3
See application file for complete search history.

(56) References Cited

U.S. PATENT DOCUMENTS

| | | | | |
|---|---|---|---|---|
| 4,036,149 | A | 7/1977 | White | |
| 4,256,042 | A | 3/1981 | Fischer | |
| 4,452,149 | A | 6/1984 | LeMarbe | |
| 4,454,822 | A | 6/1984 | Fischer | |
| 4,542,701 | A | 9/1985 | Fischer | |
| 4,601,244 | A | 7/1986 | Fischer | |
| 4,606,276 | A | 8/1986 | LeMarbe | |
| 4,617,868 | A | 10/1986 | Wahlstrom | |
| 4,869,023 | A | 9/1989 | Bakula | |
| 5,005,490 | A * | 4/1991 | Overheidt | 105/282.2 |
| 5,086,709 | A | 2/1992 | Fischer | |
| 5,163,372 | A | 11/1992 | Galvan | |
| 5,353,713 | A | 10/1994 | Dohr | |
| 5,437,232 | A | 8/1995 | Borowski | |
| 5,671,684 | A | 9/1997 | Lucas | |
| 5,676,265 | A | 10/1997 | Miller | |
| RE35,925 | E | 10/1998 | Dohr | |
| 5,845,796 | A | 12/1998 | Miller | |
| 6,019,049 | A | 2/2000 | Gaydos | |
| 6,227,124 | B1 | 5/2001 | Gaydos | |
| 6,263,803 | B1 * | 7/2001 | Dohr et al. | 105/282.3 |
| 6,264,288 | B1 | 7/2001 | Dreese | |
| 6,279,487 | B1 | 8/2001 | Gaydos | |
| 6,286,437 | B1 * | 9/2001 | Lucas | 105/282.3 |
| 6,341,422 | B1 | 1/2002 | O'Donnell | |
| 6,357,361 | B2 | 3/2002 | Dohr | |
| 6,363,863 | B1 | 4/2002 | Dohr | |
| 6,398,314 | B2 | 6/2002 | Dreese | |
| 6,412,421 | B2 | 7/2002 | Dohr | |
| 6,412,422 | B2 | 7/2002 | Dohr | |
| 6,431,084 | B1 | 8/2002 | Gaydos | |
| 6,478,173 | B2 | 11/2002 | Carlstedt | |
| 6,488,162 | B1 | 12/2002 | Carlstedt | |
| 6,520,360 | B1 | 2/2003 | Withall | |
| 6,571,718 | B2 * | 6/2003 | Lucas | 105/282.3 |
| 2001/0015151 | A1 | 8/2001 | Dohr | |
| 2001/0015152 | A1 | 8/2001 | Dohr | |
| 2001/0022467 | A1 | 9/2001 | Dreese | |
| 2003/0015117 | A1 | 1/2003 | Gaydos | |

* cited by examiner

*Primary Examiner*—S. Joseph Morano
*Assistant Examiner*—Robert J. McCarry, Jr.
(74) *Attorney, Agent, or Firm*—Chase Law Firm, L.C.

(57) ABSTRACT

A railroad hopper car discharge gate is assembled from unitary stacked frames that provide unimpeded flow of lading during discharge. A low-wear glide system minimizes friction between the gate panels and other components of the apparatus, and an improved sealing system protects lading from contaminants such as rain, dust and insect infestation and provides enhanced vacuum sealing for greater efficiency during vacuum discharge.

11 Claims, 17 Drawing Sheets

RAILWAY HOPPER CAR DISCHARGE GATE

FIELD OF THE INVENTION

This invention relates to the field of discharge gate assemblies for railway hopper cars and, more particularly, to a discharge gate for a railway hopper car that may be assembled from stacked subunits and which provides improved sealing and glide systems.

BACKGROUND OF THE INVENTION

Railroad hopper cars are used to transport bulk lading through railway systems. A railroad hopper car typically includes discharge gates located on the underside of the car for unloading the transported materials. Discharge gates typically include one or more sliding panels that may be selectively moved between open and closed positions to expose or cover an opening in the undercarriage of the car. Typically, an opening and closing drive mechanism shifts a panel between open and closed positions via a rack or racks fixed to the panel and an operating shaft. The operating shaft carries pinions which engage the racks. The operating shaft is rotated to move the panel in the desired direction. The car may be unloaded by sliding the panel to open the gate and allowing the lading to flow through the opening.

Often the materials transported comprise granular or particulate matter such as sugar, flour, grain, plastic pellets and cement. Conventional methods used to unload hopper cars include gravity discharge, vacuum discharge and pneumatic sled discharge, depending on the nature of the material transported.

During gravity discharge, lading falls from the car through a discharge opening in the gate by gravity. During vacuum discharge, lading falls from the car and through an opening in the gate into a closed vacuum chamber. Vacuum nozzles, in communication with the vacuum chamber, may project from the outer surface of the gate. A vacuum hose is connected to one or more of the vacuum nozzles and vacuum is applied to the hose. Air drawn from the car and through the gate carries lading into the vacuum chamber, through the vacuum nozzles and into the hose. During pneumatic sled discharge, a pneumatic sled is attached to the bottom of the discharge opening. The pneumatic sled includes screw type conveyors for discharging lading from the hopper car. Compressed air is blown into the discharge opening to pressurize the inside of the hopper car and separate compacted lading. The lading falls through the discharge opening and into the screw conveyors for removal.

In the case of high volume unloading, gravity discharge may be readily accomplished by simply opening the hopper car discharge gate and allowing the lading to flow downward through the gate. Gravity discharge is a common method of unloading used for materials such as unprocessed grains, feed, fertilizer, sand and soda ash. In the case of fine materials such as sugar, flour or cement, difficulties may be encountered during discharge due to significant quantities of the material becoming airborne. Such difficulties can lead to product contamination. In addition, fine materials may tend to accumulate on or within the elements of the discharge gate causing reduced outward flow of the lading, clogging of the discharge opening, and/or malfunction of the gate.

Unloaders may attach a boot to the bottom of a gravity discharge gate to feed lading to an enclosed screw conveyor. Attachment of a boot, however, is slow and awkward and the area of the gate where the boot attaches may not be sanitary. Therefore, many handlers of finished food products such as sugar and flour, and plastic pellet handlers, prefer vacuum unloading or discharge. Discharge of fine materials may accomplished using vacuum discharge methods which can increase material flow and reduce airborne particles in the work environment proximate to the gate. Vacuum discharge is particularly preferred where avoidance of contamination is important.

Difficulties in the prior art devices, however, persist relative to the seals formed between elements within the gate assembly, particularly between outer hopper or frame elements and sliding panels. Gaps between sealed components may be present as a result of dimensional variations in conventional multi-bend fabrication. In addition, surfaces for supporting the panels are prone to fouling due to build-up of transported matter, and wear due to friction caused by repetitive sliding of the panels over the support surfaces.

BRIEF DESCRIPTION OF THE INVENTION

Various aspects of the hopper car discharge gate of the present invention include improved sealing and glide systems that provide for unimpeded flow of lading during discharge, a simplified method of assembly using multiple stacked frames that may be independently fabricated, a low-wear glide system that avoids damage to gate panels and other components due to friction, and an improved sealing system that protects lading from contaminants such as rain, dust and insect infestation and provides enhanced vacuum sealing for greater efficiency during vacuum discharge.

In one embodiment of the discharge gate a generally horizontally disposed gate panel is provided that is movable in opposite directions between an open position and a closed position. A frame structure defines a discharge opening for flow of material from the hopper car, and has first and second spaced side members presenting first and second edges respectively at the discharge opening extending generally in the directions of movement of the panel. Flexible seal strips on the side members extend along the respective edges and project into the discharge opening. Transversely spaced support surfaces for the panel are provided which underlie the seal strips. The panel is mounted on the support surfaces for movement between its opened and closed positions in sliding contact with the seal strips to thereby seal the discharge opening when the panel is closed and, when opened, provide for discharge of material through the opening without accumulation at the edges of the side members and the support surfaces.

In another embodiment a method is provided for controlling discharge of material from a hopper car, and comprises the steps of providing an upper, unitary hopper subassembly presenting an opening for downward flow of material thereinto, and a second, unitary gate subassembly beneath the upper subassembly in alignment with the opening. The second subassembly has a gate panel component movable between a closed position and an opened position permitting discharge of material therethrough. A third, unitary gate subassembly may also be utilized and is positioned beneath the second subassembly for receiving material discharged therefrom, and has a gate panel component movable between a closed position, when vacuum discharge is being utilized, and an open position permitting discharge of material by gravity flow through the open gates.

Other aspects of the present invention include the utilization of elongated glide elements to present the support surfaces for gate panels, and additional sealing components, such as wiper seals, to insure that when vacuum discharge is utilized the suction provided by vacuum apparatus at the unloading facility is effectively maintained within the hopper gate.

DETAILED DESCRIPTION

Figure 6:
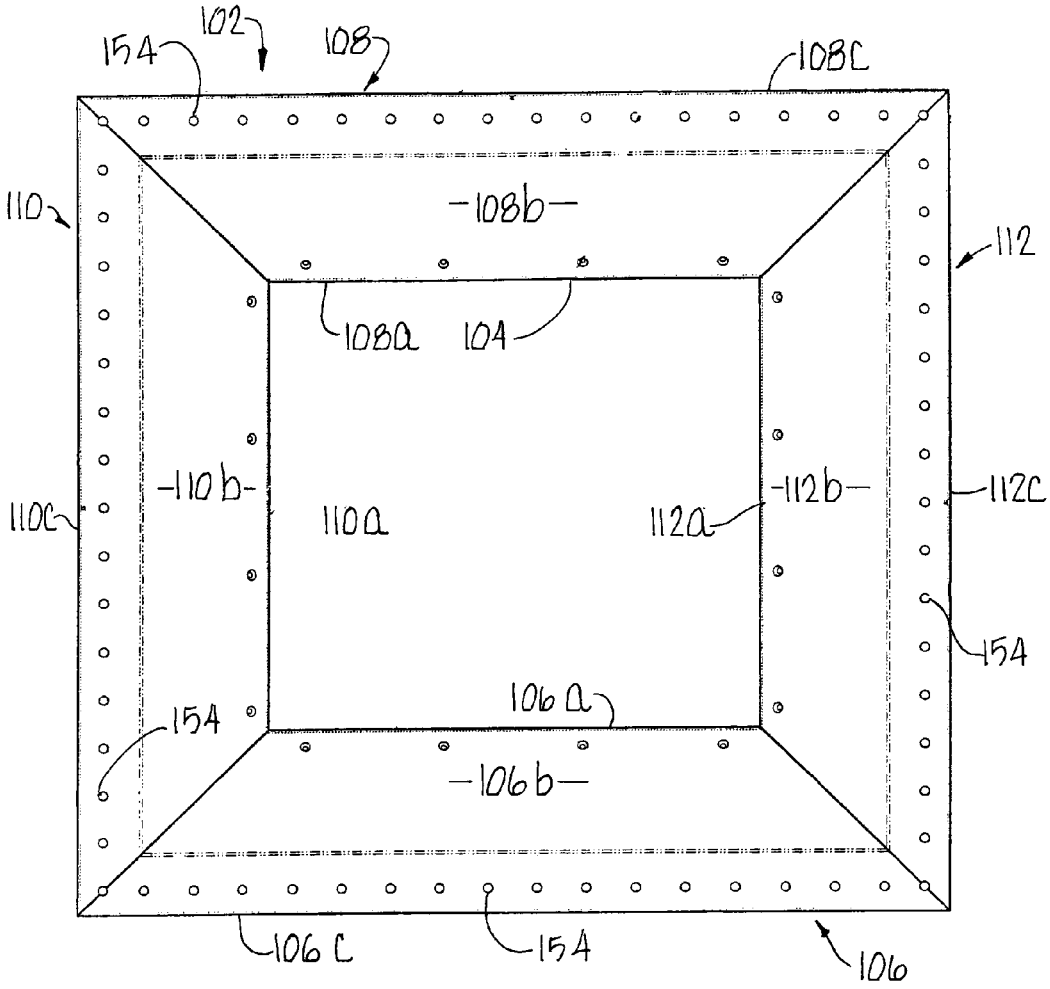
FIG. 6 is a plan view of the upper frame of the discharge gate.

Referring now to the drawings, and initially in particular to FIGS. 1-8, wherein like reference numerals indicate like parts throughout the several views, a railroad hopper car discharge gate 100 is illustrated and includes a generally rectangular upper frame or hopper 102 surrounding a generally rectangular discharge opening 104 (see FIG. 6). The upper frame 102 includes four upper sidewalls 106, 108, 110 and 112. Each of the sidewalls 106, 108, 110, and 112. Each of the sidewalls 106, 108, 110, and 112 has an inner edge 106*a*, 108*a*, 110*a*, 112*a* that, in combination, define the discharge opening 104. The discharge gate 100 may be provided with an upper door panel 114 and a lower door panel 116 that slide between open and closed positions within respective middle 118 and lower 120 frames. A pair of opposed vacuum nozzles 122 and 124 are mounted on the frames 118, 120 so as to open into a chamber below the discharge opening 104. Transversely extending upper drive shafts 126 and 128 and lower drive shafts 130 and 132 engage the upper door panel 114 and lower door panel 116 respectively, so as to move the door panels 114 and 116 between open and closed positions when the shafts 126, 128, 130 and 132 are rotated in the appropriate direction. Gears driven by the drive shafts engage racks 184 attached to the panels to provide a rack and pinion drive system.

The upper frame sidewalls 106, 108, 110 and 112 have diverging angular sides 106*b*, 108*b*, 110*b*, 112*b* that extend upwardly from the inner edges 106*a*, 108*a*, 110*a*, 112*a* toward the upper portion of the frame. Typically, the upper portion of the frame is defined by a relatively flat, horizontal lip 106*c*, 108*c*, 110*c* and 112*c* extending from each sidewall. Each lip 106*c*, 108*c*, 110*c* and 112*c* may include a plurality of mounting holes 154 spaced along its perimeter. While the discharge gate 100 may be mounted directly to the undercarriage of the railroad car via these mounting holes 154, typically a separate interface (not shown) is used to allow for differences between the hole patterns in the discharge gate 100 and the various mounting structures that may be encountered on the car.

Figure 7A:
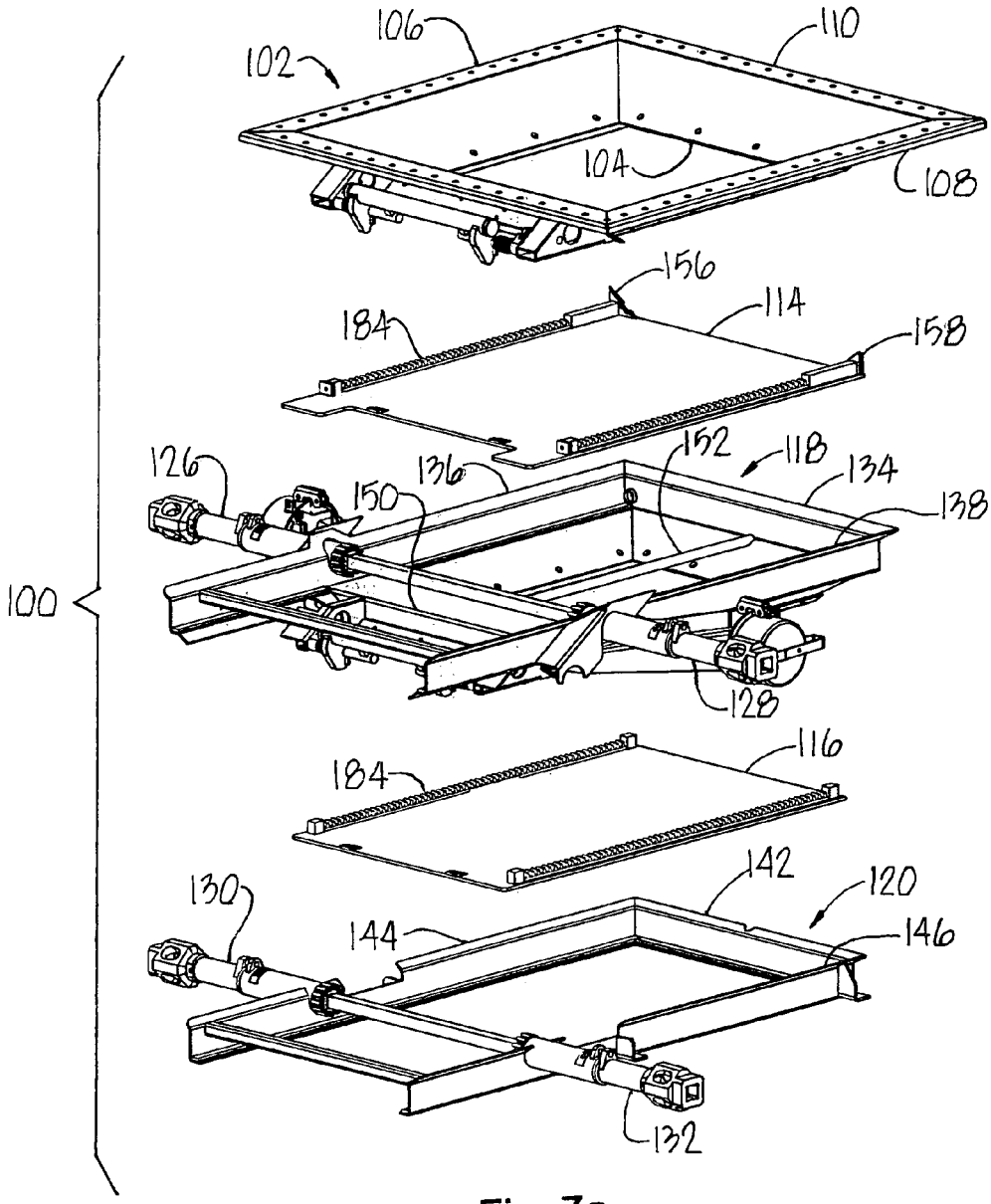
FIG. 7*a* is a partial, exploded view of the discharge gate.
Figure 7B:
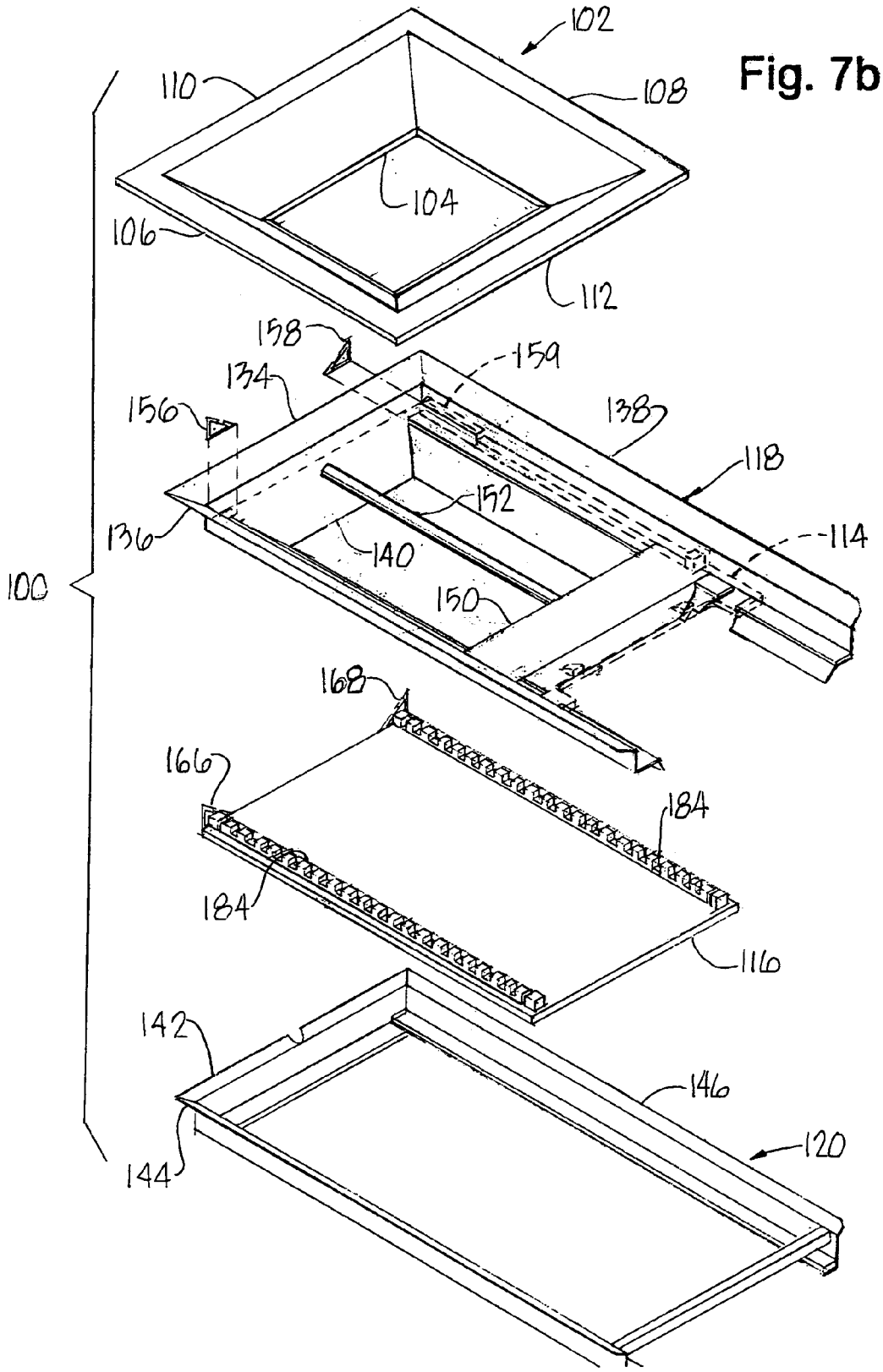
FIG. 7*b* is a partial, simplified, exploded view of the discharge gate.

FIG. 7*a* is an exploded view of the gate 100 of FIGS. 1 through 6 with major components of the gate separated from one another for clarity. FIG. 7*b* is a simplified, exploded view of the gate 100 including illustrations of some of the major components of the gate including the upper frame 102, middle frame 118, upper panel 114 (in phantom lines), lower frame 120 and lower panel 116. The middle frame 118 is secured to the underside of the upper frame 102 and comprises sidewalls 134, 136, and 138. The upper panel 114 slides within the middle frame 118 and is typically supported principally by sidewalls 136 and 138 or by support components associated with sidewalls 136 and 138. The walls of the middle frame define a lower discharge opening 140.

Figure 13:
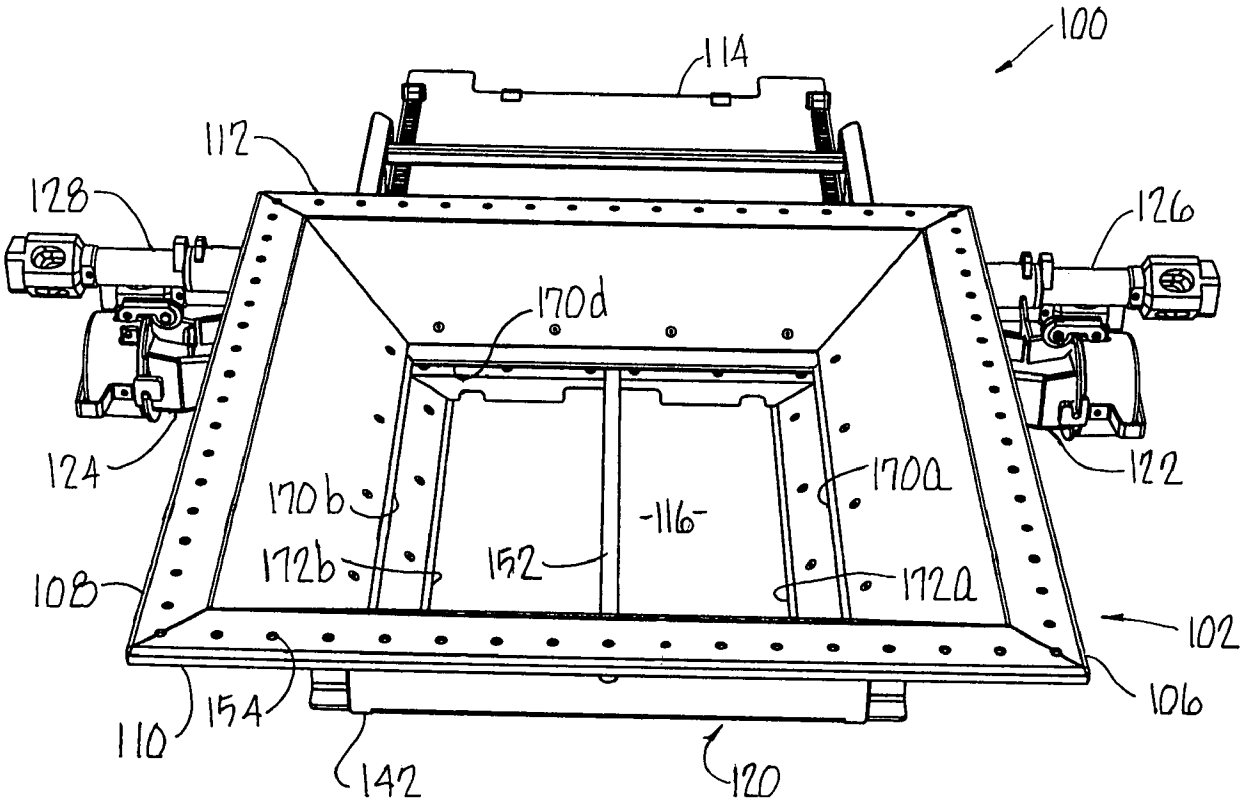
FIG. 13 is a simplified rear perspective view of the discharge gate showing the upper panel in an open position and the lower panel closed.

The lower frame is 120 is secured to the underside of the middle frame 118 and comprises sidewalls 142, 144, and 146. The lower panel 116 slides within the lower frame 120 and is typically supported principally by sidewalls 144 and 146 or by components associated with sidewalls 144 and 146. The lower discharge opening 140 may be sealed shut by positioning lower panel 116 in a closed position as shown in FIGS. 8 and 13.

Figure 8:
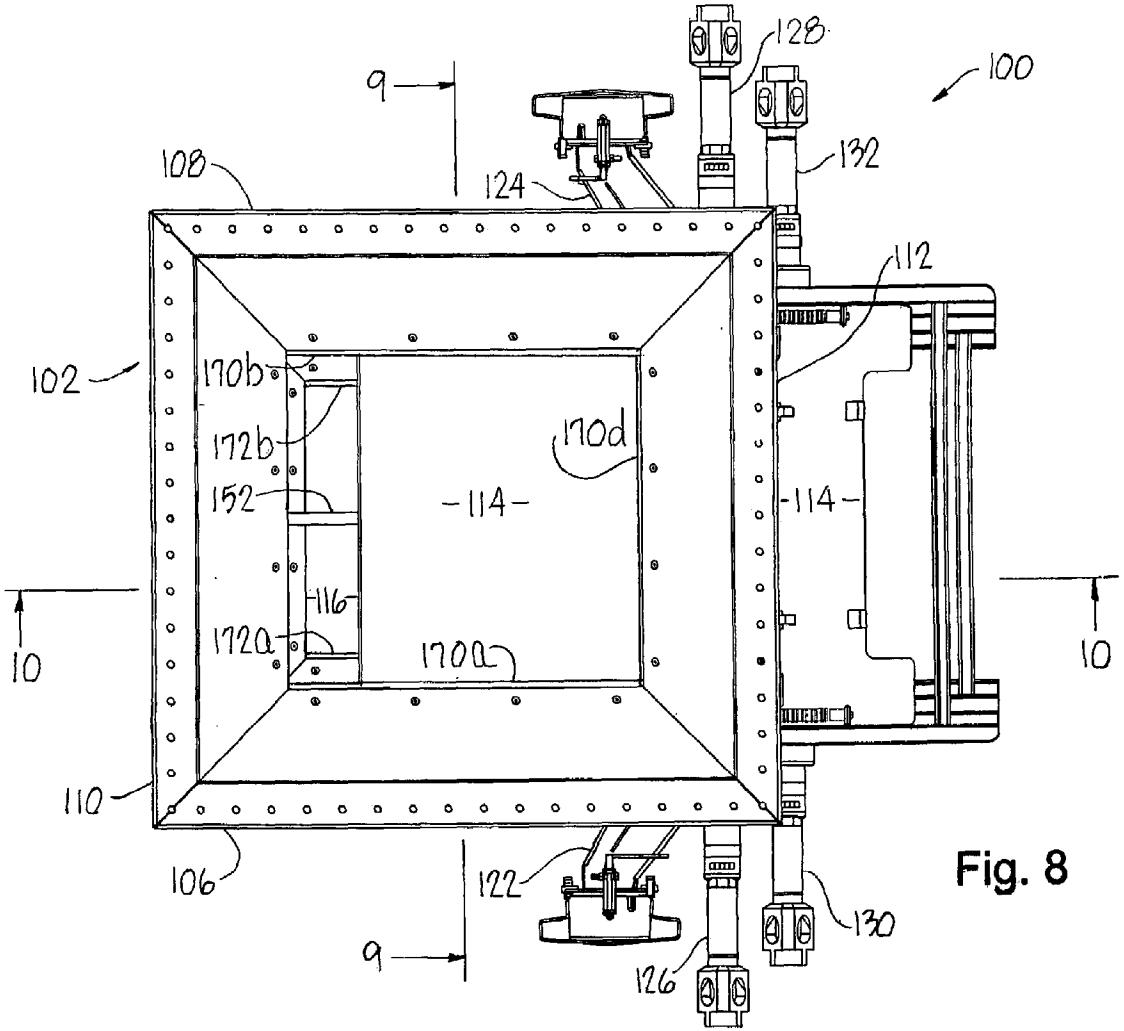
FIG. 8 is a plan view of the discharge gate, showing the upper panel partially open.
Figure 9:
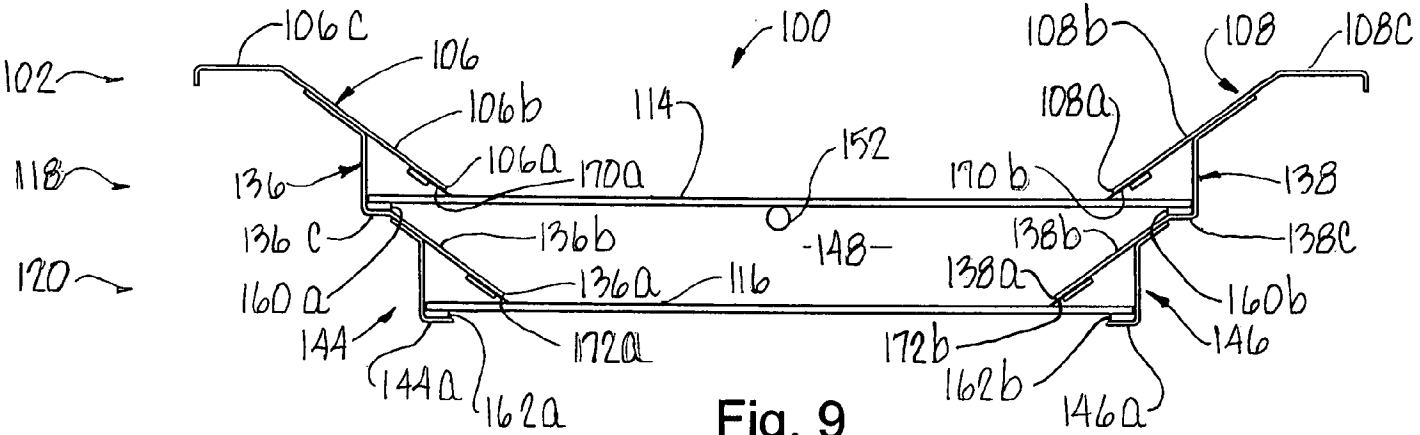
FIG. 9 is a partial, transverse, enlarged sectional diagram of the discharge gate along line 9-9 in FIG. 8.
Figure 10:
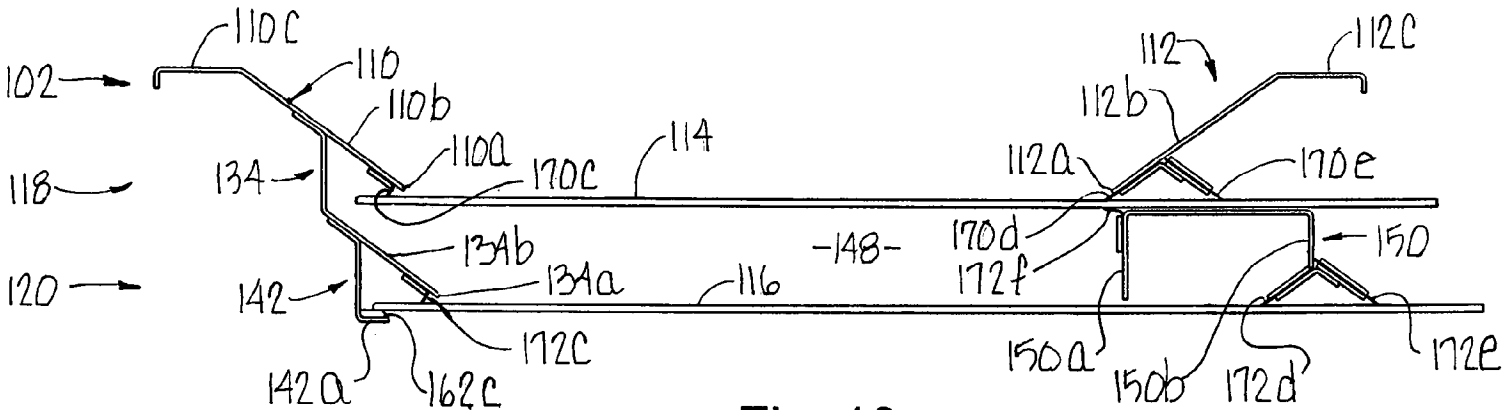
FIG. 10 is a partial, longitudinal, enlarged sectional diagram of the discharge gate along line 10-10 in FIG. 8.

When the lower panel 116 is in the closed position a sealed primary vacuum chamber 148 is formed (FIGS. 9 and 10). The primary vacuum chamber 148 is defined by lower panel 116, the sidewalls 142, 144 and 146, and a plenum 150 that forms a secondary vacuum chamber for receiving discharged material flowing from the primary vacuum chamber 148. Material then flows from the plenum 150 to the vacuum nozzles 122 and 124 (FIG. 8).

FIG. 8 is a plan view of a discharge gate 100 showing features illustrated in FIGS. 1 through 7*b* including the upper panel 114 in a partially open position to reveal the lower panel 116 below in a closed position. FIGS. 9 and 10 illustrate the relative positioning of gate elements in the stacked frame assembly of the discharge gate 100. In FIG. 10 the upper panel 114 is shown in the closed position.

As illustrated in FIG. 9, the upper frame sidewalls 106 and 108 have sloping sides 106*b* and 108*b* that extend upwardly from the sidewall edges 106*a* and 108*a* toward upper lips 106*c* and 108*c*. In FIG. 10, upper frame sidewalls 110 and 112 define the back and front of the hopper formed by the upper frame 102 and also have sloping sides 110*b* and 112*b* that extend upwardly from edges 110*a* and 112*a* to upper lips 110*c* and 112*c*.

The middle frame 118 is positioned below, and is attached to, the upper frame 102. The middle frame 118 includes two transversely spaced, parallel sidewalls 136 and 138 that define a space below the discharge opening 104. In FIG. 9, the middle frame sidewalls 136 and 138 extend downward from the upper frame sloping sides 106*b* and 108*b*. Ledges 136*c* and 138*c* project from the inner surfaces of the support walls 136 and 138 to present an L-shaped configuration as viewed in FIG. 9. The ledges 136*c* and 138*c* include upper glide elements 160*a* and 160*b* such as flat strips or bars of bronze or ultra high molecular weight (UHMW) plastic. The upper panel 114 is supported within the middle frame 118 upon these glide surfaces 160*a* and 160*b* so that the upper panel 114 may slide across the upper discharge opening 104 between open and closed positions. Additional support for the upper panel 114 may provided by a center rail 152 (see FIGS. 1, 7*a*, 7*b*, 8, 9, and 13). Typically, the rail 152 is in the form of a cylinder or rectangular bar. Preferably, the rail 152 is formed of bronze, steel capped with bronze, or steel capped with UHMW plastic.

The sidewalls 136 and 138 of the middle frame 118 include integral lower sidewalls 136*b* and 138*b* that extend inwardly at an angle from the ledges 136*c* and 138*c*. The lower sidewalls 136*b* and 138*b* terminate at inner edges 136*a* and 138*a*. In FIG. 10 the front sidewall 134 of the middle frame 118 extends downward from sloping side 110*b* of the upper frame 102 and includes surface 134*b* that slopes inwardly to edge 134*a*. Edges 134*a*, 136*a* and 138*a* partially define the borders of the lower discharge opening 140.

A lower frame 120 may be positioned below and attached to the middle frame 118 in order to assemble a discharge gate 100 suitable for vacuum discharge. As illustrated in FIGS. 9 and 10, the lower frame 120 includes two elongated, spaced, parallel sidewalls 144 and 146 that extend downward from the middle frame sloping sides 136*b* and 138*b*. Sidewall 142 extends downward from sloping side 134*b*. Ledges 142*a*, 144*a* and 146*a* project inward from sidewalls 142, 144 and 146 to support a lower door panel 116 which may slide across the lower discharge opening 140 between a closed position shown in FIG. 10 and an open position (not shown) displaced to the right as viewed in FIG. 10. The ledges 144*a*, 146*a* and 142*a* are provided with glide elements 162*a*, 162*b* and 162*c*, respectively, to provide low friction surfaces.

The lower door panel 116 is positioned below the edges 136*a* and 138*a* and rests on support structures provided by the lower frame 120 that may comprise ledges 144*a* and 146*a* formed from, or projecting from, the lower frame sidewalls 144 and 146. Since the lower door panel 116 is not typically subject to weight exerted by lading during transport, as is upper door panel 114 which is used to close the opening in the railroad car, additional support for the lower door panel 116 is typically not required but may provided by a center rail (not shown).

From the forgoing, it may be appreciated that the sloping surfaces thereby provided by upper frame 102 and middle frame 118 allow material discharged from a railroad car to readily flow down the surfaces of the walls and through the upper and lower discharge openings 104 and 140.

As illustrated in FIGS. 7*a*, 7*b* and 10, discharge gate 100 is adapted for vacuum discharge and includes plenum 150 for receiving discharged lading and directing the lading to vacuum nozzles 122 and 124 (see FIGS. 1-8). The plenum 150 may be attached to, or integral with, the middle frame 118. As shown in FIG. 10, the forward wall 150*a* of the plenum 150 forms the rear wall of the primary vacuum chamber, and the front wall of the secondary vacuum chamber. FIG. 13 is a front perspective view of a discharge gate 100 in which the upper panel 114 is in an open position and the lower panel 116 is in a closed position. Lading passing through the upper frame 102 falls through the upper discharge opening 104 onto lower panel 116. Vacuum applied to vacuum nozzle 122 and/or 124 draws the lading through a space or spaces provided between the lower panel 116 and the forward wall 150*a* of the plenum 150.

Figure 14:
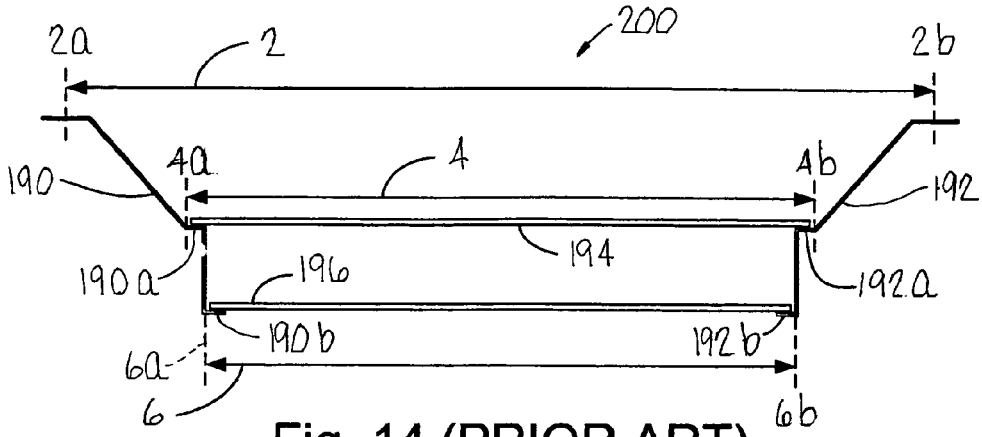
Fig. 14 (PRIOR ART)
FIG. 14 is a partial sectional diagram of a railroad discharge gate in the prior art.

The stacked assembly method of construction whereby separate unitary bodies comprising the upper frame 102, middle frame 118 and lower frame 120 are assembled to construct a discharge gate, provides significant advantages both in the construction and in the operation and use of the assembled device. In the prior art, a discharge gate 200, as illustrated in diagrammatical form in FIG. 14, is typically formed in the shape of a hopper having inwardly sloping sidewalls 190 and 192 that define one or more discharge openings. Ledges 190*a* and 192*a* or similar structures for supporting panels or doors 194 and 196 are typically formed by creating a series of bends in each wall. When assembling the gate 200 several important dimensional criteria are considered. First, if the gate is to be mounted to the underside of a railroad hopper car by using holes provided in the upper lip of the sidewalls 190 and 192, then it is important that the holes align with matching attachment structures on the railroad car. For example the distance between points 2*a* and 2*b* as indicated by arrow 2 in FIG. 14 should be maintained during assembly of the discharge gate 200. In addition, the distance between points 4*a* and 4*b*, as indicated by arrow 4, should be maintained so that upper panel 194 may slide freely upon ledges 190*a* and 192*a* and between walls 190 and 192, while minimizing the gap between walls 190 and 192 and the proximate edges of the panels 194 and 196. In addition, the distance between points 6*a* and 6*b*, as indicated by arrow 6, should also be maintained so that the lower panel 196 may slide freely upon ledges 190*b* and 192*b* and between walls 190 and 192. Ledges 190*a* and 192*a*, and 190*b* and 192*b*, along with respective tranverse panel support members (not shown) should also be assembled so as to present support surfaces in a common plane. Otherwise an associated panel will not be evenly supported. Although other criteria may also apply, achieving close tolerances may present a considerable difficulty in the prior art due to the number of sequential bends required in each section of sidewall.

Figure 15:
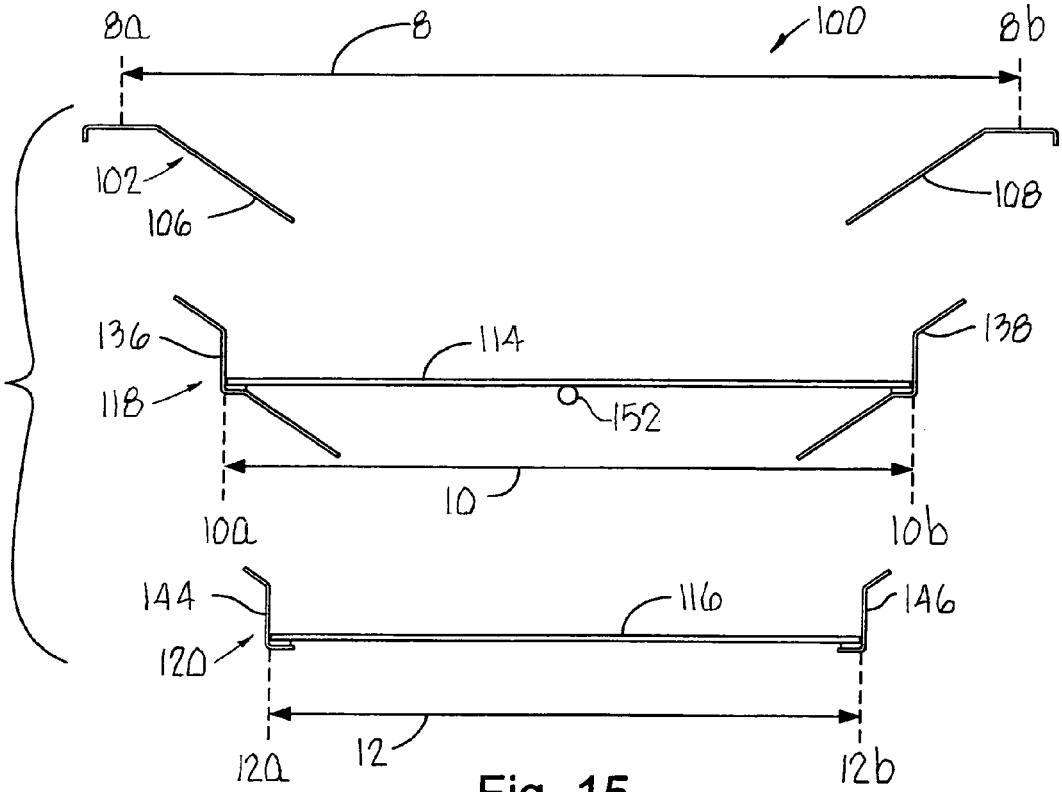
FIG. 15 is an exploded, partial sectional diagram of a discharge gate in accordance with an aspect of the present invention.

The discharge gate 100 is formed by stacking previously assembled gate components comprising the upper frame 102, middle frame 118 and lower frame 120. Each component, therefore, may be constructed with only one of the above criteria being critical to the final component dimensions. For example, when constructing the upper frame 102 the required distance between points 8*a* and 8*b*, as represented by arrow 8, may be maintained without the need for considering, or making adjustments based on, the distance between middle or lower frame ledges. As shown in FIG. 15 the upper frame 102, middle frame 118, and lower frame 120 may each be constructed independently in a manner that maximizes precision and accuracy of distances 8, 10, and 12. Because the mating surfaces of the upper, middle and lower frames are angled and nest one inside the other, they tend to be self centering and therefore slight deviations from the norm in one frame will tend not to affect the critical dimensions of the other frames.

Figure 11:
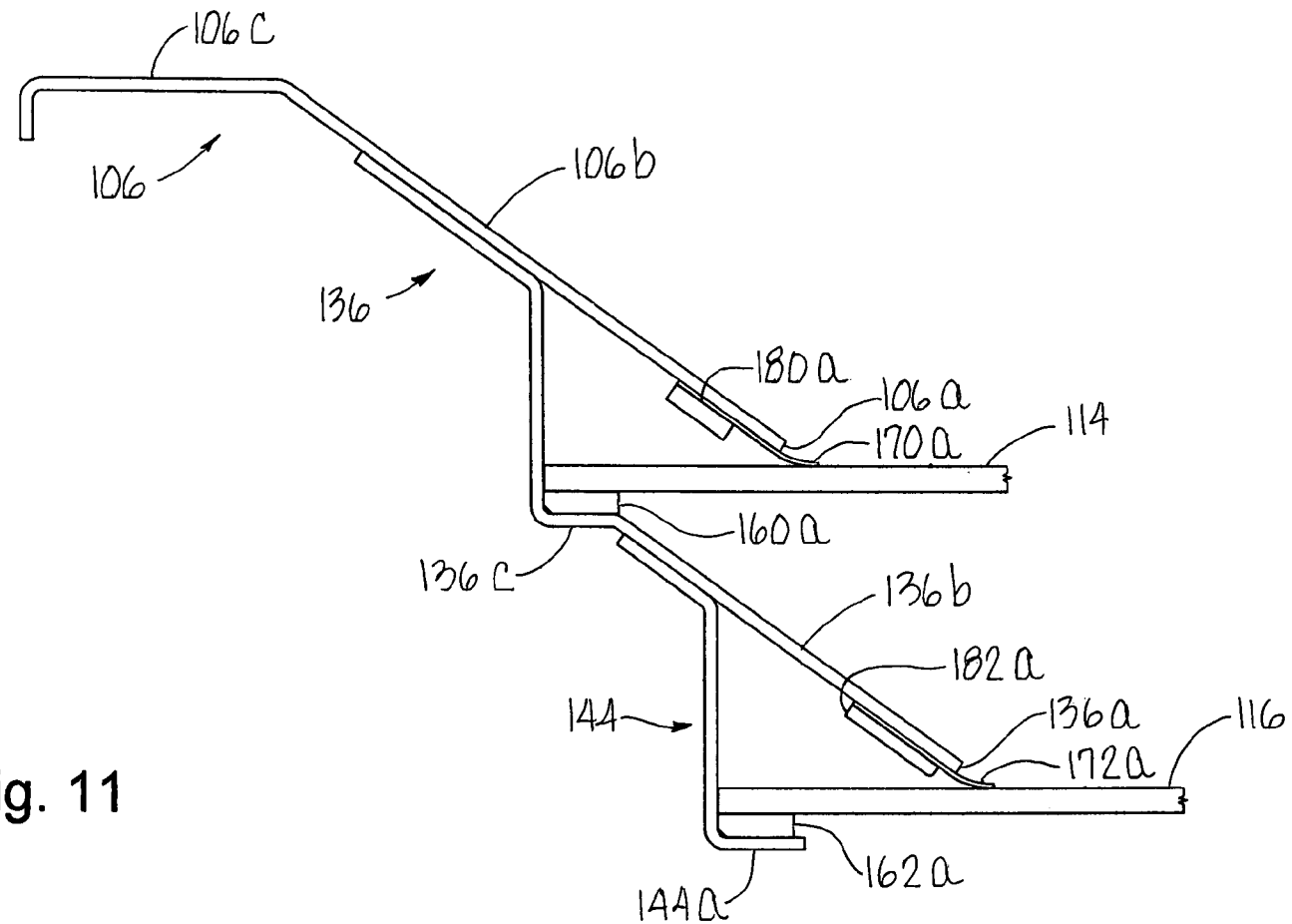
FIG. 11 is a further enlarged, partial view of the diagram of FIG. 9.
Figure 12:
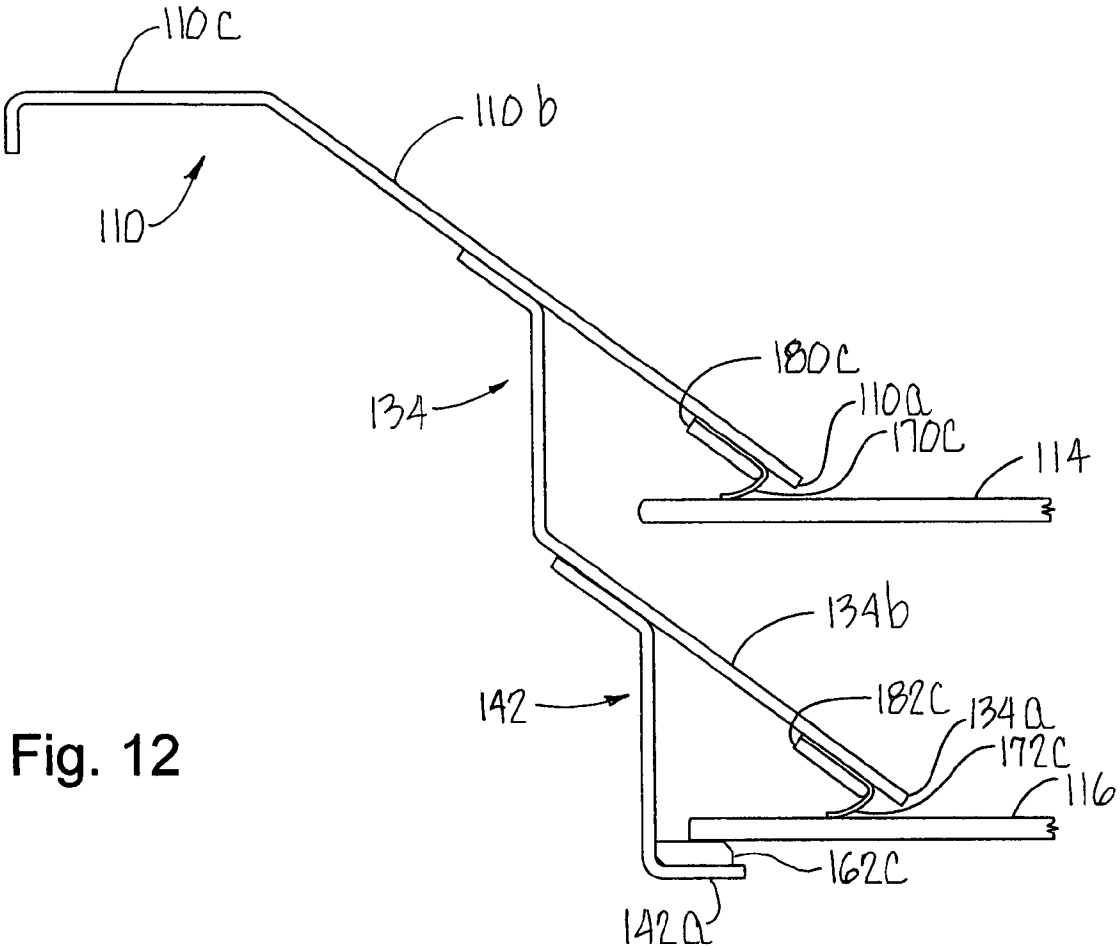
FIG. 12 is a further enlarged, partial view of the diagram of FIG. 10.

To maximize the efficiency of vacuum discharge, the discharge gate 100 may be provided with a system of seals to close gaps within the gate assembly, particularly gaps between stationary frame elements and moveable elements such as the upper and lower panels 114 and 116. FIGS. 9 and 10 disclose a system of seals attached to the side edges of the upper and middle frame 102 and 118 sidewalls. For clarity, FIG. 11 is provided as an enlarged partial view of FIG. 9, illustrating seals associated with sidewalls 136 and 144. FIG. 12 is provided as an enlarged partial view of FIG. 10.

Flexible seal strips (see FIGS. 11 and 12), preferably formed from a resilient material such as ultra high molecular weight (UHMW) polyethylene, are attached to the underside of the upper frame 102 sidewalls 106, 108, 110 and 112, for sealing against upper door panel 114. Similar seal strips are attached to the underside of the middle frame 118 sidewalls 134, 136 and 138 and plenum rearward wall 150*b* for sealing against lower door panel 116.

In particular, as illustrated in FIG. 11, seal strip 170*a* is attached to the underside of sidewall edge 106*a* so as to contact the upper surface of upper panel 114. Seal strip 172*a* is attached to the underside of sidewall edge 136*a* so as to contact the upper surface of lower panel 116. Similarly, seal strip 170*c* is attached to the underside of sidewall edge 110*a* and seal strip 172*c* is attached to the underside of sidewall edge 134*a* to contact the surface of upper panel 114 and lower panel 116, respectively. To minimize wear and/or failure of seal strips 170*c* and 172*c* due to repetitive contact with the leading edges of panels 114 and 116, seal strips 170*c* and 172*c* may be bent to face in a forward direction as shown in FIGS. 12 and 10.

The seal strips extend along the associated sidewall edges and project partially into the proximate discharge openings 104 or 140 (FIG. 7*b*). As shown in FIGS. 11 and 12, seal strips, for example 170*a*, 172*a*, 170*c* and 172*c*, may be held by compression in a sandwiched configuration between the underside of sloping sides 106*b*, 136*b*, 110*b* and 134*b* and backing strips or blocks 180*a*, 182*a*, 180*c* and 182*c*. Preferably the panels are disposed so that the seal strips are forced to deflect and press against the surface of the panels thereby enhancing the seal created between a given seal strip and the associated panel.

The bottom wall of the plenum 150 is formed by the lower panel 116. Therefore, when the lower panel 116 is fully opened the plenum 150 is open on the bottom for ready access for cleaning. In addition, when the lower panel 116 is fully opened a sanitary sealing surface is exposed (see seals 172*a*, 172*b*, 172*c* and 172*d*) for sealing a boot to the bottom of the gate 100.

Figure 16:
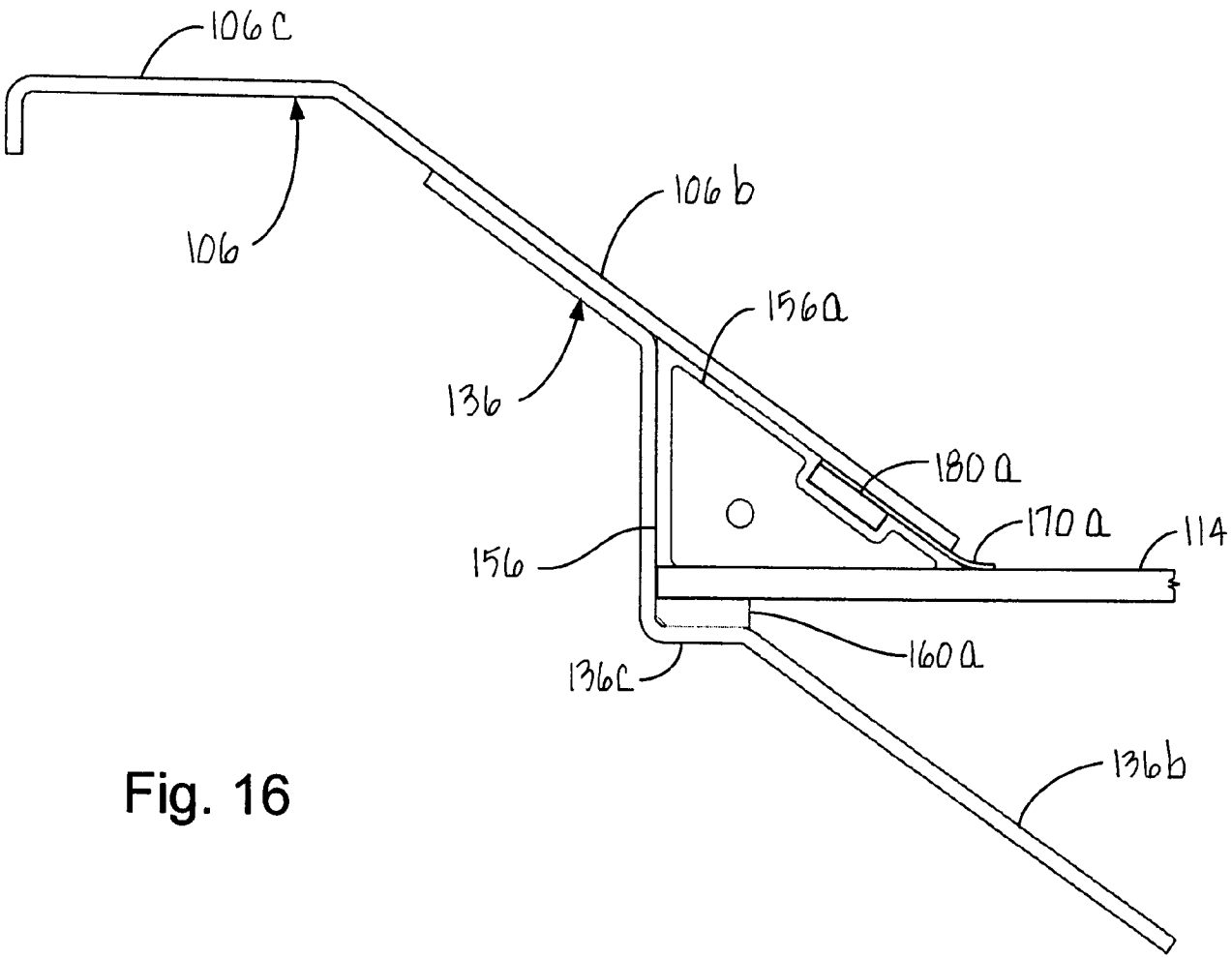
FIG. 16 is a partial, diagrammatic view showing a triangular seal in place inside a chamber created by the interface of upper and middle frame sides and an upper panel.
Figure 17:
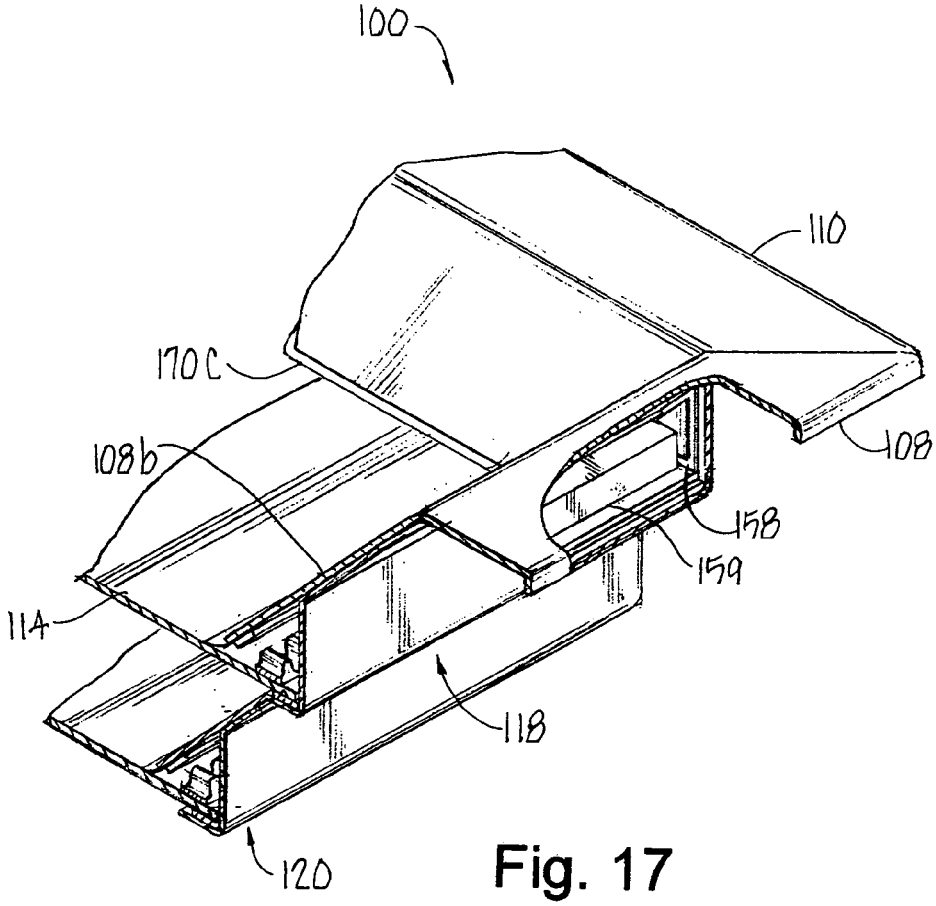
FIG. 17 is a partial perspective view with parts broken away to show the interior of triangular chambers formed by the interface of upper and lower panels and sidewalls of the upper, middle and lower frames.

As can be seen in FIGS. 9 and 11, a chamber, generally triangular in cross-section, is formed by the sloping side 106*b*, panel 114 and sidewall 136. Similar chambers are formed where panel 114 meets sidewall 138 and 108*b*, and where panel 116 meets sidewall 136 and 144, and 138 and 146. When the upper panel 114 is in a partially open to fully open position the associated triangular chambers present potential air paths from the primary vacuum chamber 148 to the exterior of the discharge gate 100. To block this route for loss of vacuum during vacuum discharge, triangular seals adapted to fit the interior contours of the triangular chambers are positioned at the forward end of panel 114. As can be seen in FIGS. 7*a* and 7*b*, triangular seals 156 and 158 are affixed to the forward end of panel 114 (drawn in phantom lines in FIG. 7*b*) and are positioned to project perpendicularly upward from the upper surface of the panel 114. Triangular seals 166 and 168 (FIG. 7*b*) may be affixed to the forward end of lower panel 116 in a similar manner if the device 100 is to be unloaded using a vacuum sled or bottom boot instead of the vacuum outlets 122, 124. FIG. 16 is a cross-sectional diagram showing a triangular seal 156 in place inside a triangular chamber created by the interface of side 106*b*, 136 and upper panel 114. A complementary triangular backing block 156*a* is used to compress the seal 156 against an attachment block or flange 159 (FIGS. 7*a*, 7*b* and 17) projecting from the upper panel 114. Triangular seals may be sandwiched between two triangular backing blocks. As the upper panel 114 is moved between open and closed positions, the triangular seal 156 wipes the interior of the chamber and acts as a barrier between the area of the chamber forward of the seal 156 and the exterior of the gate 100. FIG. 17 is a partial cut-away showing the interior of such a triangular chamber formed by the interface of panel 114, sloping side 108*b* and sidewall 108. As illustrated, the upper panel 114 is in the closed position.

Additional vacuum air leakage can occur between the bottom surface of the upper door panel 114 and the top of the rear cross member. To seal this zone a seal 172*f* is affixed to the forward wall 150*a* of the rear cross member 150 so as to wipe against the bottom surface of the upper door panel 114 (see FIG. 10). Rear seals 170*d* and 172*d* provide the primary sanitary seal to the top of their respective door plates, and additional seals 170*e* and 172*e* are mounted at a reverse incline to scrape heavy road debris from the top surfaces of the door panels 114 and 116 and to provide a secondary seal against dirt and moisture, including rain.

Figure 1:
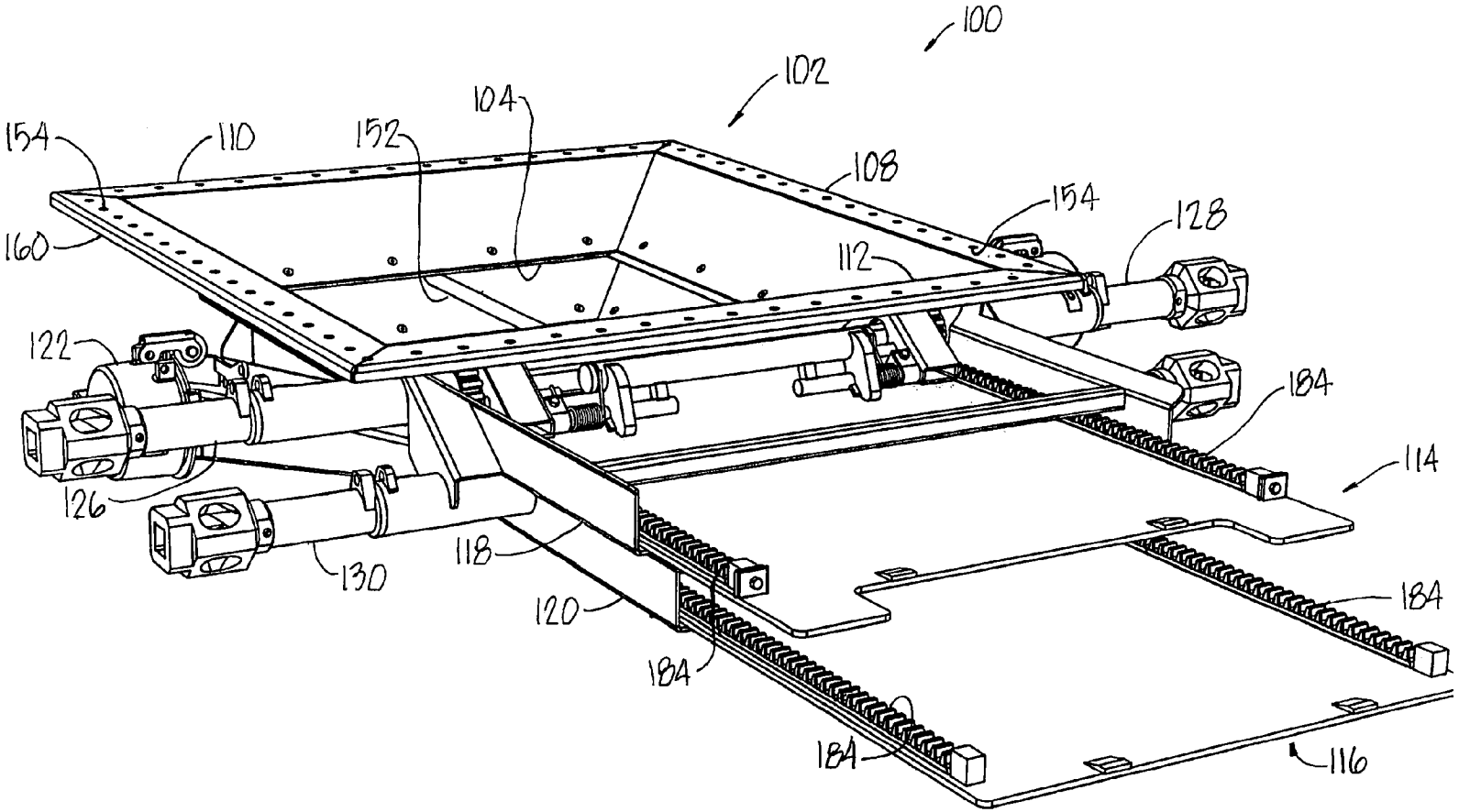
FIG. 1 is a frontal and side perspective view of a two-door, railroad car discharge gate in accordance with an embodiment of the present invention.
Figure 2:
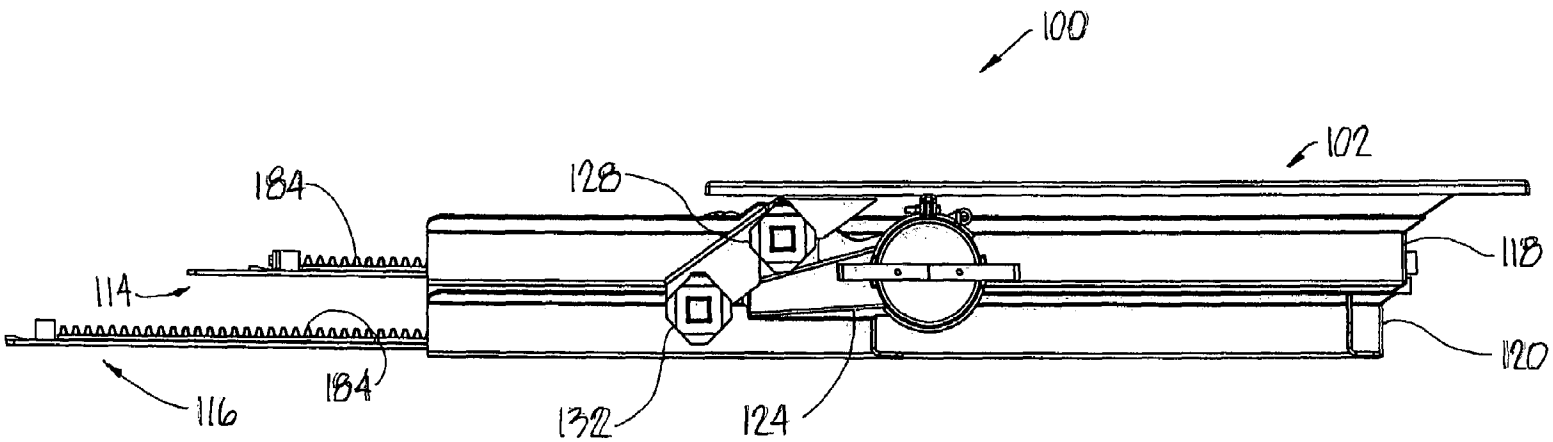
FIG. 2 is a side elevational view of the discharge gate of FIG. 1.
Figure 3:
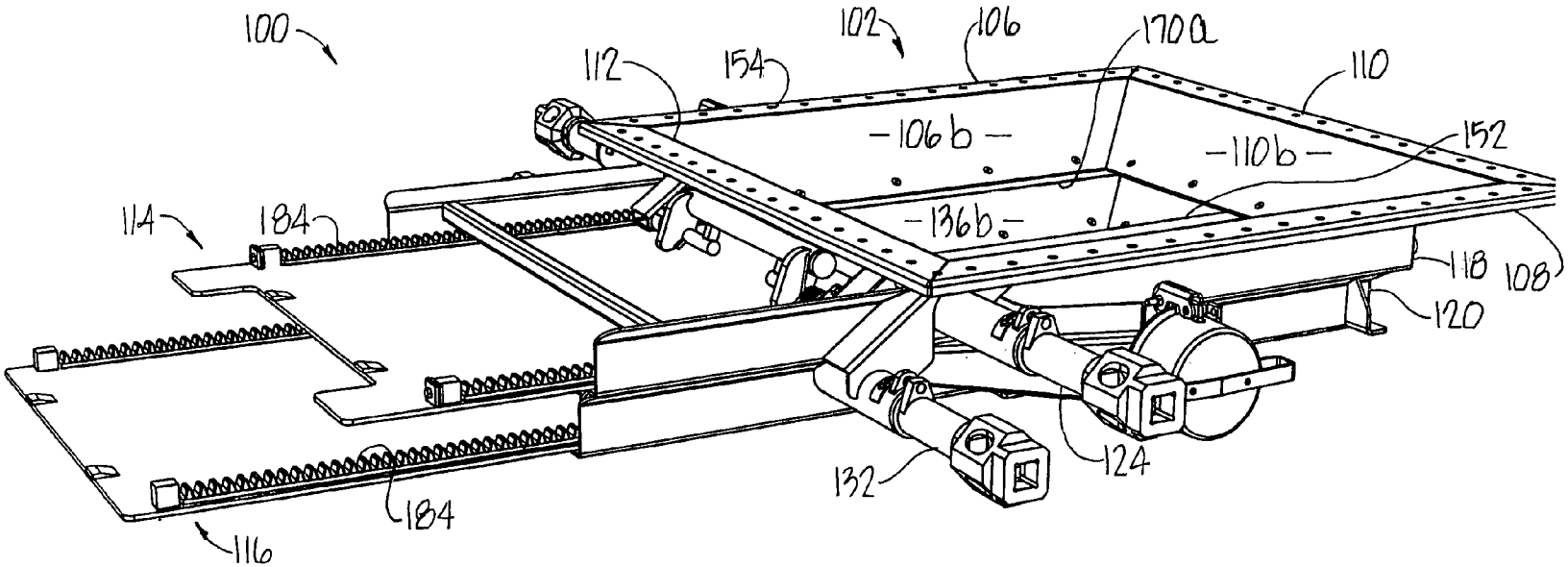
FIG. 3 is a side perspective view of the discharge gate.
Figure 4:
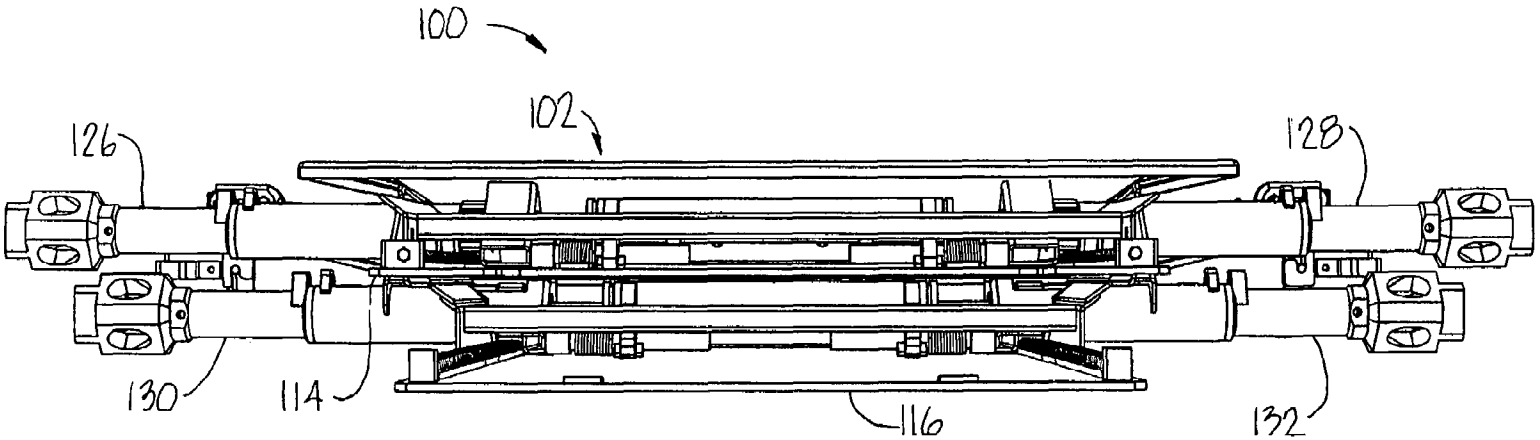
FIG. 4 is a front perspective view of the discharge gate.
Figure 5:
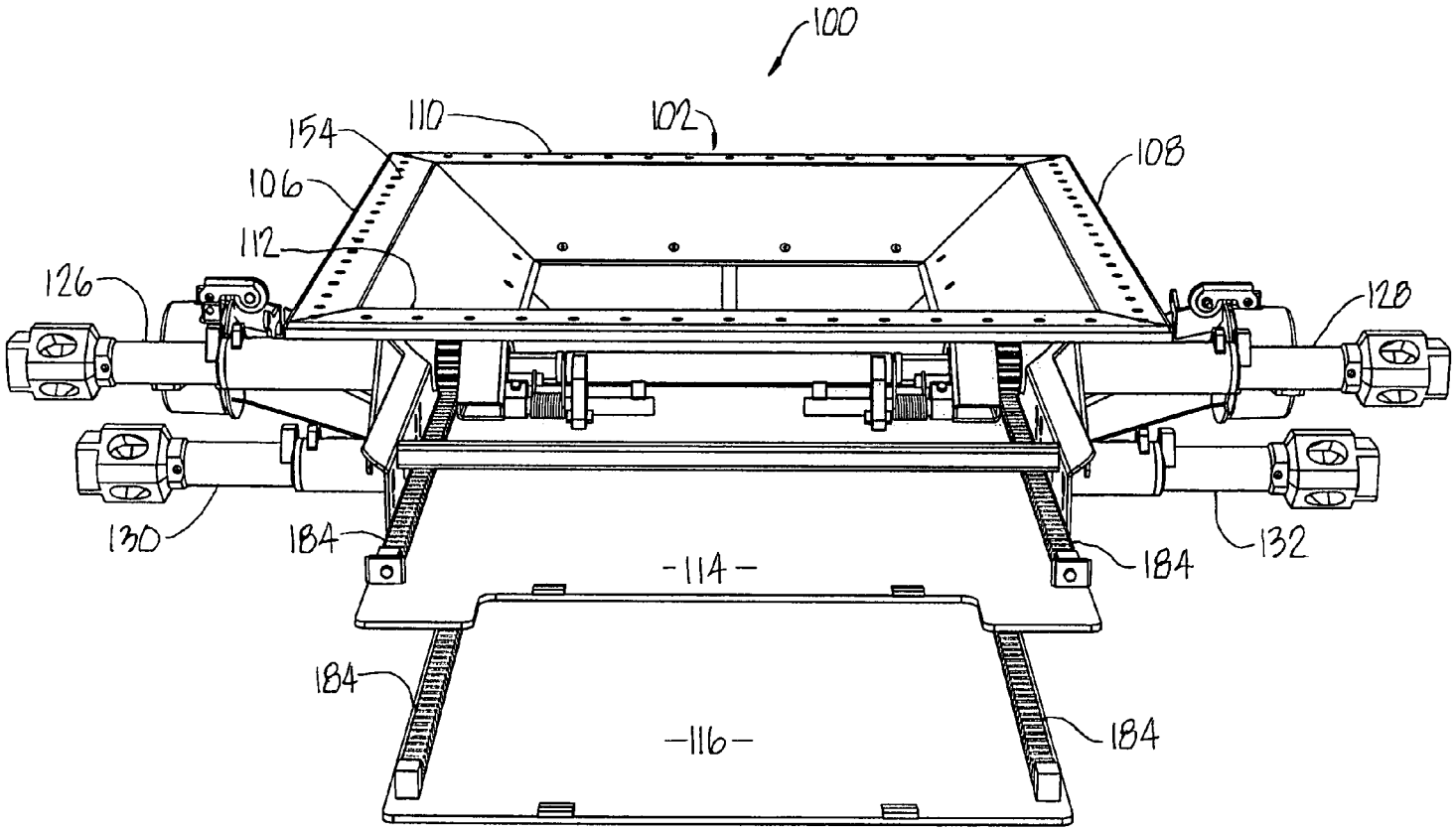
FIG. 5 is an upper, front perspective view of the discharge gate.
Figure 19:
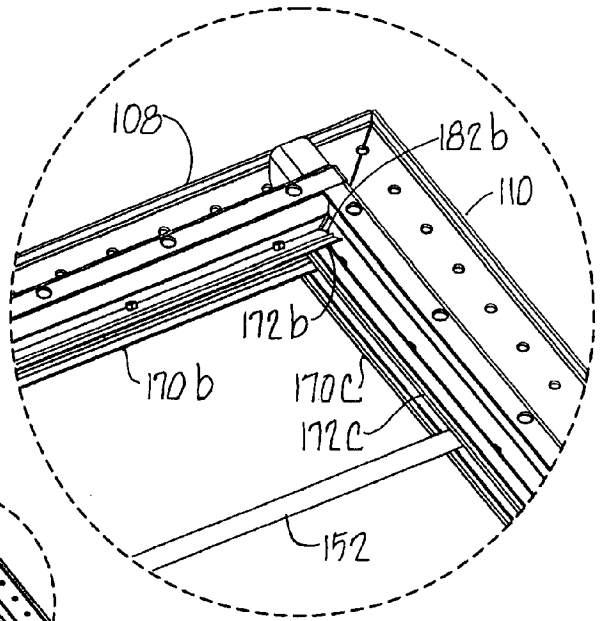
FIG. 19 is an enlarged portion of the view of FIG. 18.
Figure 18:
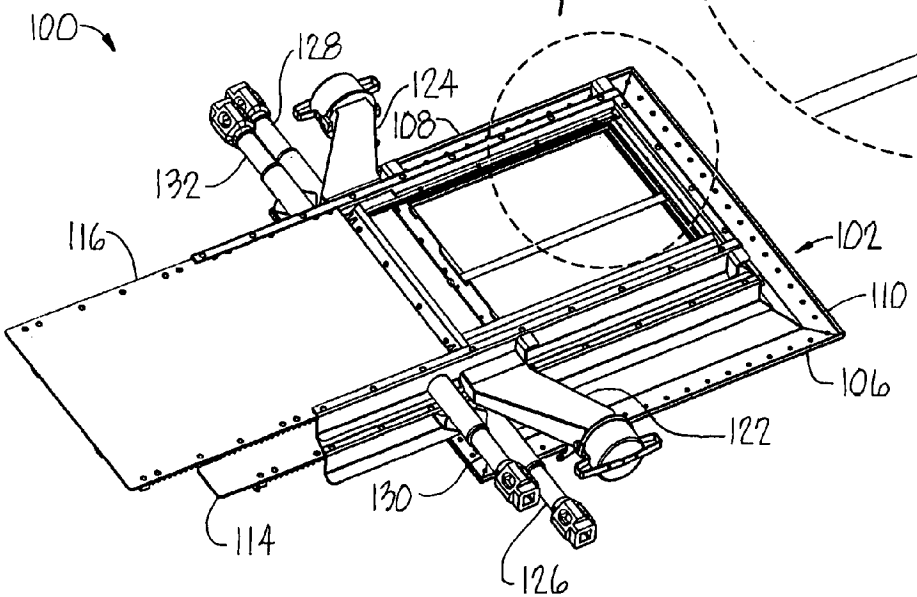
FIG. 18 is a bottom perspective view of the discharge gate of FIG. 1.

FIG. 18 is a bottom perspective view of the discharge gate 100 of FIG. 1. FIG. 19 is an enlarged portion of the view of FIG. 18 showing a portion of the bottom surface of the hopper 102 and seals 170*b*, 172*b*, 170*c* and 172*c*.

It is to be understood that while certain forms of this invention have been illustrated and described, it is not limited thereto except insofar as such limitations are included in the following claims and allowable equivalents thereof.

The invention claimed is:

1. A method of providing an apparatus for controlling discharge of material from a hopper car, said method comprising the steps of:

providing a unitary hopper subassembly presenting a generally rectangular opening for downward flow of material thereinto, said subassembly including an upper frame having a first upper sidewall and a spaced, generally parallel second upper sidewall, said sidewalls presenting first and second sidewall edges respectively at said opening, a first upper end wall and a spaced, generally parallel second upper end wall, said end walls presenting first and second end wall edges respectively at said opening, a first flexible seal strip on said first sidewall extending along said first sidewall edge and projecting into said opening, a second flexible seal strip on said second sidewall extending along said second sidewall edge and projecting into said opening, a third flexible seal strip on said first end wall extending along said first end wall edge and projecting into said opening, and a fourth flexible seal strip on said second end wall extending along said second end wall edge and projecting into said opening, providing a unitary gate subassembly having a panel component moveable between a closed, sealed position and an open position permitting discharge of material through the gate subassembly, said panel component being in contact with said first, second, third and fourth seal strips when in the closed position to provide a complete seal, and positioning said gate subassembly beneath said hopper subassembly in alignment with said opening for receiving material therefrom.

2. A stacked assembly discharge gate apparatus comprising:

a generally rectangular upper frame defining a generally rectangular discharge opening, said upper frame including a first upper sidewall and a spaced, generally parallel second upper sidewall, said sidewalls presenting first and second sidewall edges respectively at said opening, a first upper end wall and a spaced, generally parallel second upper end wall, said end walls presenting first and second end wall edges respectively at said opening, a first flexible seal strip on said first sidewall extending along said first sidewall edge and projecting into said opening, a second flexible seal strip on said second sidewall extending along said second sidewall edge and projecting into said opening, a third flexible seal strip on said first end wall extending along said first end wall edge and projecting into said opening, a fourth flexible seal strip on said second end wall extending along said second end wall edge and projecting into said opening, a second frame attached below said upper frame, said second frame including first and second spaced parallel support walls defining a space therebetween communicating with said discharge opening, said support walls having inner, opposing surfaces, a first ledge projecting into said space from said first support wall inner surface, a second ledge projecting into said space from said second support wall inner surface, said first and second ledges including horizontally disposed upper glide surfaces, and a panel supported within said second frame and upon said glide surfaces whereby said panel may slide across said space between open and closed positions.

3. The stacked assembly discharge gate apparatus of claim 2, further comprising:

a third frame attached below said second frame, said third frame including third and fourth spaced parallel support walls further defining said space therebetween, said support walls having inner, opposing surfaces, a third ledge projecting into said space from said third support wall inner surface, a fourth ledge projecting into said space from said fourth support wall inner surface, said third and fourth ledges including horizontally disposed lower glide surfaces, and a lower panel supported within said third frame and upon said glide surfaces whereby said lower panel may slide across said space between open and closed positions.

4. The discharge gate apparatus as claimed in claim 3, wherein said first and second support walls present first and second support wall edges proximal to said space, said second frame further comprises a front wall and a rear wall for further enclosing said space, said front wall and rear wall presenting edges proximal to said space, and further comprising:

a first flexible seal strip on said first support wall extending along said first support wall edge and projecting into said space, a second flexible seal strip on said second support wall extending along said second support wall edge and projecting into said space, a third flexible seal strip on said front wall extending along said front wall edge and projecting into said space, and a fourth flexible seal strip on said rear wall extending along said rear wall edge and projecting into said space, whereby said first mentioned panel and said lower panel may form an enclosed, sealed space when said panels are in the closed position.

5. A railway discharge gate apparatus comprising:

a generally rectangular upper frame defining a generally rectangular discharge opening, a second frame attached below said upper frame, a gate panel supported within said second frame for sliding movement in a direction across said discharge opening between open and closed positions, said upper frame, second frame and panel cooperating to define first and second transversely spaced, generally longitudinal passages extending in said direction, said first passage having a predetermined, transverse, first configuration, said second passage having a predetermined, transverse, second configuration, a first seal attached to a portion of said panel within said first passage and presenting a configuration complementary to said first configuration, and a second seal attached to a portion of said panel within said second passage and presenting a configuration complementary to said second configuration, whereby said seals move with said panel and travel within said passages in contact with the sides of said passages to form a barrier between the interior of said passages and the exterior of the gate apparatus.

6. The railway discharge gate apparatus as claimed in claim 5, wherein said first and second passage configurations and first and second seal configurations are generally triangular.

7. A discharge gate apparatus for a hopper car comprising:

frame structure defining a discharge opening and including first and second spaced, generally parallel sidewalls presenting first and second sidewall edges respectively at said opening, and first and second spaced, generally parallel end walls presenting first and second end wall edges respectively at said opening, a generally horizontally disposed panel movable in opposite directions generally parallel to said sidewall edges between an open position and a closed position with respect to said discharge opening, a first resilient seal strip on said first sidewall extending along said first sidewall edge and projecting into said opening, a second resilient seal strip on said second sidewall extending along said second sidewall edge and projecting into said opening, flexible end wall seals extending along said first and second end wall edges for sealing said end wall edges when said panel is in its closed position, said frame structure having first and second ledges projecting into said opening and presenting glide surfaces extending in said directions beneath respective first and second seal strips, and said panel being supported on said glide surfaces for movement in said directions and having an upper surface in sliding contact with said first and second seal strips and deflecting said strips to provide a line of seal at each of said seal strips and the underlying panel surface extending in said directions, whereby the discharge opening is sealed by the sidewall and end wall seals when the panel is closed and, when opened, material discharges without accumulating at said glide surfaces.

8. The discharge gate apparatus as claimed in claim 7, wherein said glide surfaces are spaced laterally outwardly from respective seal strips clear of said discharge opening to preclude accumulation of material thereon during discharge.

9. In the discharge gate apparatus as claimed in claim 7, wherein each of said seal strips comprises an elongated wiper extending along the associated edge.

10. In the discharge gate apparatus as claimed in claim 7, wherein said glide surfaces are presented by an ultra high molecular weight plastic material.

11. In the discharge gate apparatus as claimed in claim 7, wherein said glide surfaces are bronze.

* * * * *